US006970670B2

(12) United States Patent
Konishi et al.

(10) Patent No.: US 6,970,670 B2
(45) Date of Patent: Nov. 29, 2005

(54) IMAGE FORMING DEVICE

(75) Inventors: Takashi Konishi, Nagaokakyo (JP); Daisuke Shige, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 35 days.

(21) Appl. No.: 10/706,058

(22) Filed: Nov. 12, 2003

(65) Prior Publication Data

US 2004/0197114 A1 Oct. 7, 2004

(30) Foreign Application Priority Data

Nov. 13, 2002 (JP) ..... 2002-329172

(51) Int. Cl.[7] ..... G03G 15/00
(52) U.S. Cl. ..... 399/167; 399/71
(58) Field of Search ..... 399/71, 343, 353, 399/167, 139, 359, 98, 34, 352, 357

(56) References Cited

U.S. PATENT DOCUMENTS 4,240,739 A * 12/1980 Koumura et al. ..... 399/139
5,619,316 A * 4/1997 Shoji et al. ..... 399/359
5,819,138 A * 10/1998 Hashizume ..... 399/98

FOREIGN PATENT DOCUMENTS

JP 03137668 A * 6/1991 ..... G03G 15/20
JP 03-156484 7/1991
JP 08-069231 3/1996
JP 08123284 A * 5/1996 ..... G03G 21/10
JP 09-258622 10/1997
JP 11-327409 11/1999
JP 2000-112311 4/2000
JP 2000-162936 6/2000
JP 2000-206846 7/2000
JP 2002296998 A * 10/2002 ..... G03G 21/10
JP 2002311771 A * 10/2002 ..... G03G 21/10

* cited by examiner

*Primary Examiner*—Quana Grainger
(74) *Attorney, Agent, or Firm*—Hogan & Hartson, LLP

(57) ABSTRACT

An image forming device includes a photoconductive drum, a motor which rotates the photoconductive drum, a charging unit which charges a surface of the photoconductive drum, an exposing unit which writes image information as an electrostatic latent image onto the charged surface of the photoconductive drum, a developing unit which develops the electrostatic latent image, a transfer unit which transfers the developed image onto a paper, a paper dust removing unit which removes paper dusts by contacting against the surface of the paper dust removing unit, and a rotation mechanism which intermittently rotates the paper dust removing unit.

9 Claims, 7 Drawing Sheets

IMAGE FORMING DEVICE

BACKGROUND OF THE INVENTION

1. Field of the Invention

The present invention relates to an electro-photographic typed image forming device provided in a facsimile machine, a copy machine or the like.

2. Description of the Related Art

There is an electro-photographic typed image forming device which includes a photoconductive drum driven by a rotation driving mechanism, a charging unit which charges the photoconductive drum, an exposing unit which writes image information as an electrostatic latent image onto the charged photoconductive drum, a developing unit which develops the electrostatic latent image formed by the exposing unit, a transfer unit which transfers the developed image onto a recording medium, and a paper dust removing unit which contacts against the surface of the photoconductive drum to remove paper dust.

In the above-mentioned image forming device, a positive charging process that positively charges the surface of the photoconductive drum has been drawing attention recently.

When carrying out a corona charging process, in case of a negative corona discharge, ozone is generated, and in case of a positive corona discharge, ozone is not generated. Therefore, under the positive charging process, a corona discharging typed charging unit can be used, and the surface of the photoconductive drum can be charged uniformly under low cost. Moreover, a positively charged toner suitable for the positive charging process is being developed to be put into practical use.

However, paper dust is prone to be charged negatively. Therefore, when transferring an image onto paper, there are cases when the paper dust adhere to the positively charged surface of the photoconductive drum to cause a failure in charging or white spots. To avoid such a problem, it is necessary to provide a brush for removing the paper dust. When a fixed brush is used for the brush, the duration of the brush is shorter than the duration of the drum. Therefore, when the brush for removing the paper dust and the photoconductive drum are formed as one unit, the duration of the unit is determined by the duration of the brush for removing the paper dust. As a result, a photoconductive drum which can be still used is abandoned.

As a countermeasure, there is a proposal to form the brush for removing the paper dust as a rotating brush. However, in this case, a process to remove the paper dust by contacting a flicker against the brush becomes necessary, and it also becomes necessary to provide a space for accumulating the removed paper dust.

SUMMARY OF THE INVENTION

An image forming device of the present invention includes a photoconductive drum which is driven by a rotation driving mechanism, a charging unit which positively charges the photoconductive drum, an exposing unit which writes image information as an electrostatic latent image onto the charged photoconductive drum, a developing unit which develops the electrostatic latent image formed by the exposing unit, a transfer unit which transfers the developed image onto a recording medium, and a paper dust removing unit which removes paper dusts by contacting against a surface of the paper dust removing unit. The image forming device also includes a rotation mechanism which intermittently rotates the paper dust removing unit, and a control unit which controls the rotation mechanism.

In the image forming device of the present invention, it is preferable for the rotation mechanism of the paper dust removing unit to contact against the rotation driving mechanism of the photoconductive drum via a one-way clutch. In addition, when a prescribed condition is reached, it is preferable for the control unit to rotate the photoconductive drum backward by the rotation driving mechanism of the photoconductive drum, and to rotate the paper dust removing unit by a prescribed angle.

In the image forming device of the present invention, it is preferable to rotate the photoconductive drum backward each time an image is formed on a recording medium for a prescribed number of sheets.

According to the image forming device of the present invention, a different part of the paper dust removing unit contacts against the photoconductive drum each time the paper dust removing unit is rotated intermittently. Therefore, the duration of the paper dust removing unit prolongs. Furthermore, since the paper dust removing unit is not rotating at all times, it becomes unnecessary to remove the paper dust adhered to the paper dust removing unit such as a flicker. Therefore, the duration of the paper dust removing unit and the photoconductive drum formed as one unit can also be prolonged. Furthermore, the space for accumulating the paper dusts can be reduced.

DETAILED DESCRIPTION OF THE PREFERRED EMBODIMENTS

The embodiments of the present invention will be described in detail.

Figure 1:
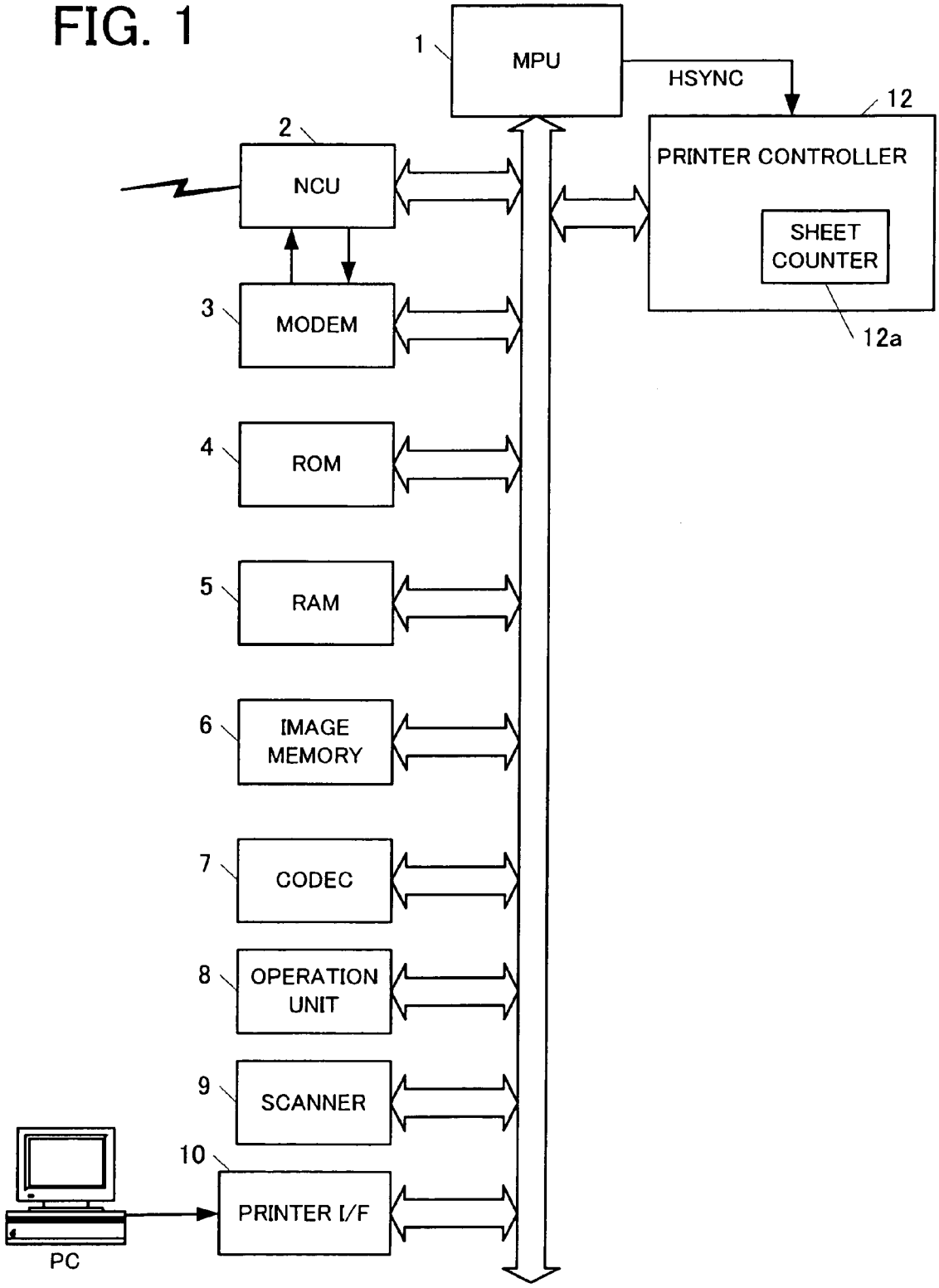
FIG. 1 is a block diagram showing an image forming device according to an embodiment of the present invention.
Figure 2:
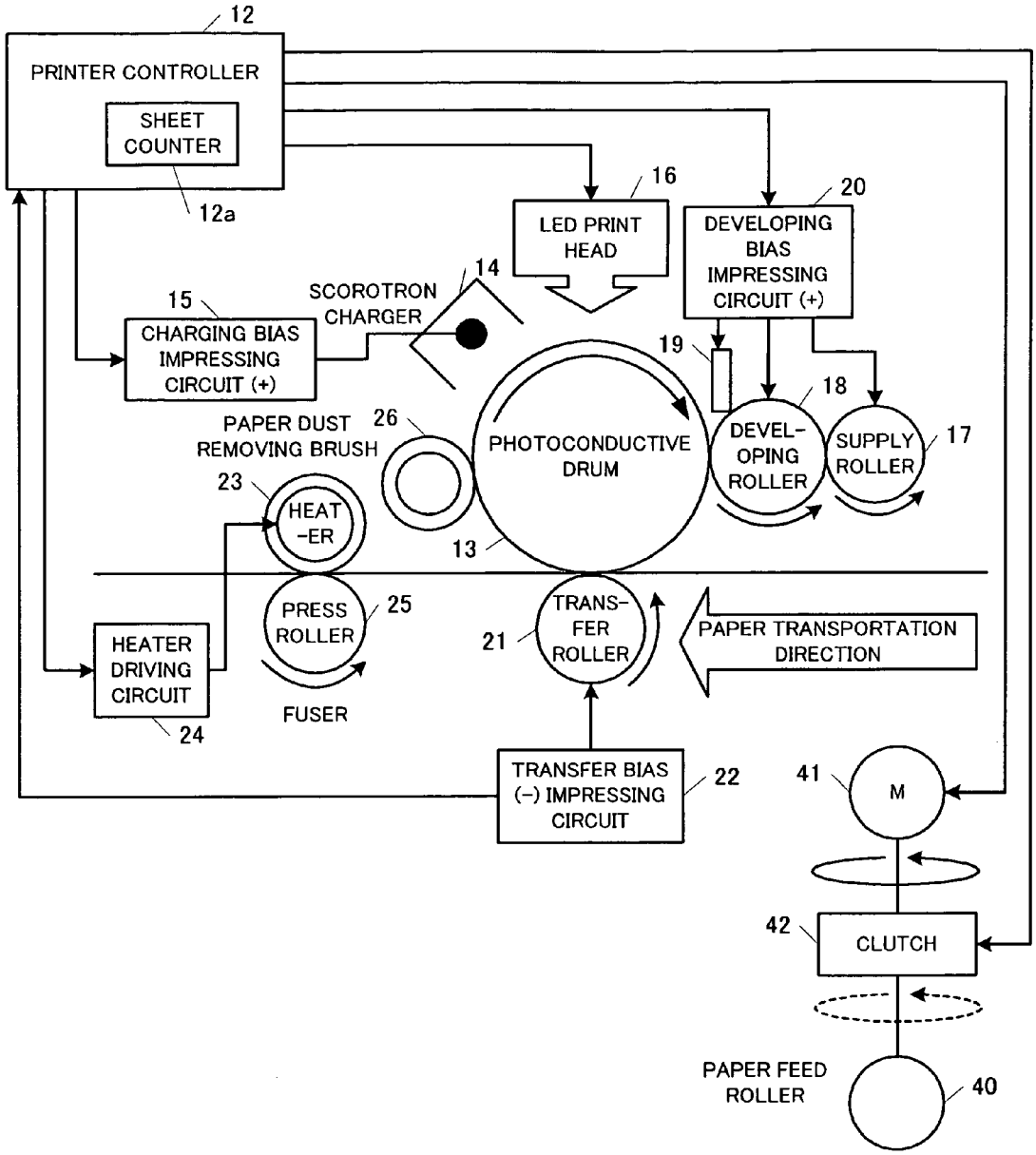
FIG. 2 is a block diagram showing a printer of the image forming device according to the embodiment.

FIG. 1 is a block diagram showing an image forming device 100 according to an embodiment of the present invention. FIG. 2 is a block diagram showing a printer 101 of the image forming device 100. The image forming device 100 is formed as a multifunction peripheral having a facsimile function and a copy function. As shown in FIG. 1, the image forming device 100 includes a Micro Processing Unit (MPU) 1, a Network Control Unit (NCU) 2, a modem 3, a Read Only Memory (ROM) 4, a Random Access Memory (RAM) 5, an image memory (Dynamic Random Access Memory (DRAM)) 6, a Coder and Decoder (CODEC) 7, an operation unit 8, a scanner 9, and a printer interface 10. In addition, the image forming device 100 includes an electro-photographic typed printer 101 formed as shown in FIG. 2, and a transportation mechanism part which transports a recording medium (paper) from a paper feed cassette (not shown) to a transfer roller 21 and a press roller 25.

The MPU 1 controls each of the parts of the image forming device 100. The NCU 2 controls a connection established with a Public Switched Telephone Network (PSTN). The NCU 2 includes a function for transmitting a dial signal according to a telephone number (including a facsimile number) of a receiver and a function for detecting an incoming call. The modem 3 modulates transmission data and demodulates received data by following V.17, V.27ter, V.29 or the like in accordance with a facsimile transmission control protocol following the International Telecommunication Union-Telecommunications (ITU-T) Recommendations T.30. Alternatively, the modem 3 modulates transmission data and demodulates received data by following V.34 in addition to the ones mentioned above.

The ROM 4 stores a program for controlling the image forming device 100. The RAM 5 temporarily stores data or the like. The image memory 6 temporarily stores received image data or image data scanned by the scanner 9. The CODEC 7 encodes the scanned image data in accordance with Modified Huffman (MH), Modified Read (MR), Modified Modified Read (MMR) methods or the like for transmitting the image data, and decodes the received image data. The operation unit 8 is used by a user for instructing a facsimile transmission/reception, printing, or the like. The scanner 9 scans image data of an original document when carrying out a facsimile transmission. The printer interface 10 receives a print command and data from a Personal Computer (PC), and transmits the command and the data to a printer controller 12 to be described later.

The printer 101 of the image forming device 100 includes the printer controller 12 for controlling each part of the printer 101. A sheet counter 12*a* is provided inside the printer controller 12. A photoconductive drum 13 having a photoconductive film on an outer peripheral surface is provided in the printer 101. The photoconductive drum 13 is rotated by a motor 41. A scorotron charger 14 as a charging unit is provided at a periphery of the photoconductive drum 13. A prescribed bias voltage is impressed by a charging bias impressing circuit 15 to the scorotron charger 14. The scorotron charger 14 impressed with the bias voltage charges the photoconductive drum 13 uniformly so that the outer peripheral surface of the photoconductive drum 13 becomes approximately +800V. A Light Emitting Diode (LED) print head 16 as an exposing unit, which is provided at a periphery of the photoconductive drum 13, consists of a plurality of LEDs. The LED print head 16 radiates light on the outer peripheral surface of the photoconductive drum 13 in accordance with input image information, and forms an electrostatic latent image corresponding to the image information on the outer peripheral surface.

Furthermore, a developer provided at a periphery of the photoconductive drum 13 includes a supply roller 17, a developing roller 18, a blade 19, and a developing bias impressing circuit 20. While charging toner, the supply roller 17 supplies toner to the developing roller 18 from a toner case 27 storing positively charged toner. The developing bias impressing circuit 20 impresses a prescribed bias voltage (for example, +300V to +700V) to the supply roller 17. A prescribed bias voltage (for example, +300V to +600V, preferably +450V) is impressed by the developing bias impressing circuit 20 to the developing roller 18 disposed in contact with the supply roller 17 and the photoconductive drum 13.

The blade 19 contacts resiliently against the outer peripheral surface of the developing roller 18, and equalizes the thickness of the toner adhered to the outer peripheral surface of the developing roller 18. A prescribed bias voltage (+300 to +700V) is impressed to the blade 19 by the developing bias impressing circuit 20.

Furthermore, a transfer roller 21 is provided at a periphery of the photoconductive drum 13. The transfer roller 21 is disposed in contact with the outer peripheral surface of the photoconductive drum 13 across a paper transportation path. The transfer roller 21 is rotated by a motor 41. A prescribed bias voltage is impressed by a transfer bias impressing circuit 22 to the transfer roller 21.

A fuser disposed at a downstream side of the paper transportation path includes a heat roller 23 having a heater, a heater driving circuit 24, and a press roller 25. The heater of the heat roller 23 is heated by the heater driving circuit 24 so that the outer peripheral surface of the heat roller 23 reaches a prescribed temperature. A paper transferred with a toner image by the transfer roller 21 is heat-pressed by the heat roller 23 and the press roller 25 so that the toner image on the paper is fused.

Figure 4:
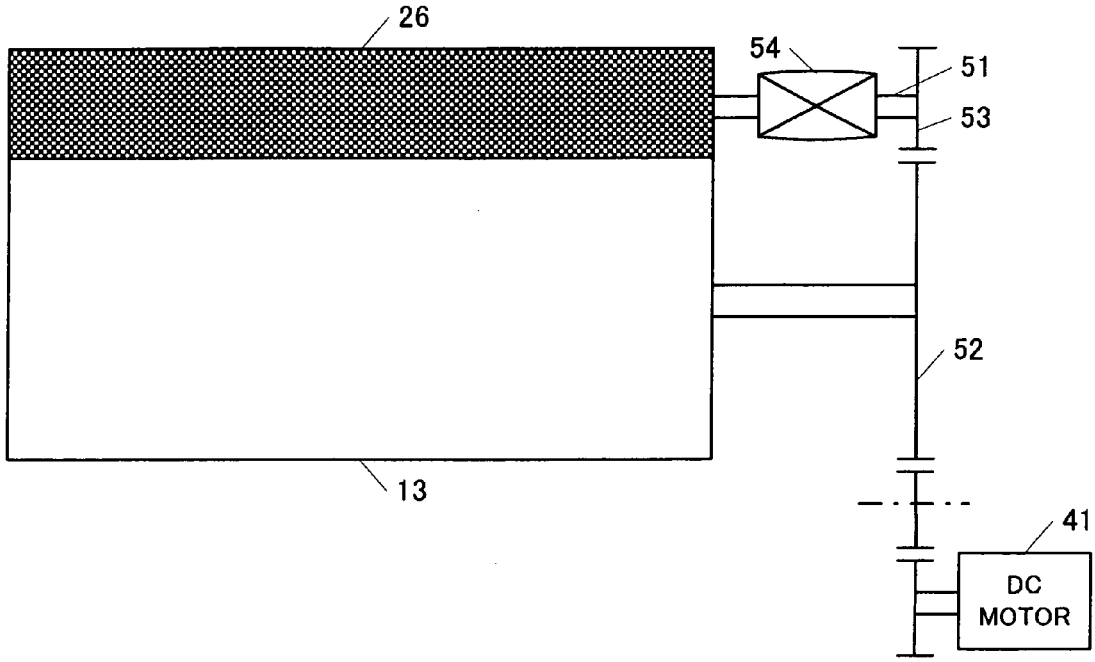
FIG. 4 shows an example of a transfer mechanism of a driving force to a photoconductive drum and a paper dust removing brush.

In the image forming device 100, a paper dust removing brush 26 is disposed between the scorotron charger 14 and the transfer roller 21 at the periphery of the photoconductive drum 13. As shown in FIG. 4, a gear 53 with a one-way clutch 54 is provided to a shaft 51 of the paper dust removing brush 26, and the gear 53 is engaged with a gear 52 of the photoconductive drum 13. The one-way clutch 54 transfers the driving force of the photoconductive drum 13 to the shaft 51 only when the photoconductive drum 13 is rotated backward. The driving force of the photoconductive drum 13 is not transferred to the paper dust removing brush 26 when the photoconductive drum 13 is rotated forward. In other words, when a prescribed number of sheets have been printed, the photoconductive drum 13 rotates backward and the paper dust removing brush 26 rotates. A period of time when the photoconductive drum 13 rotates backward is set at a time corresponding to approximately 30 degrees by a rotation angle of the photoconductive drum 13. Thus, an adverse effect on the photoconductive drum 13 due to the backward rotation is small.

Figure 3:
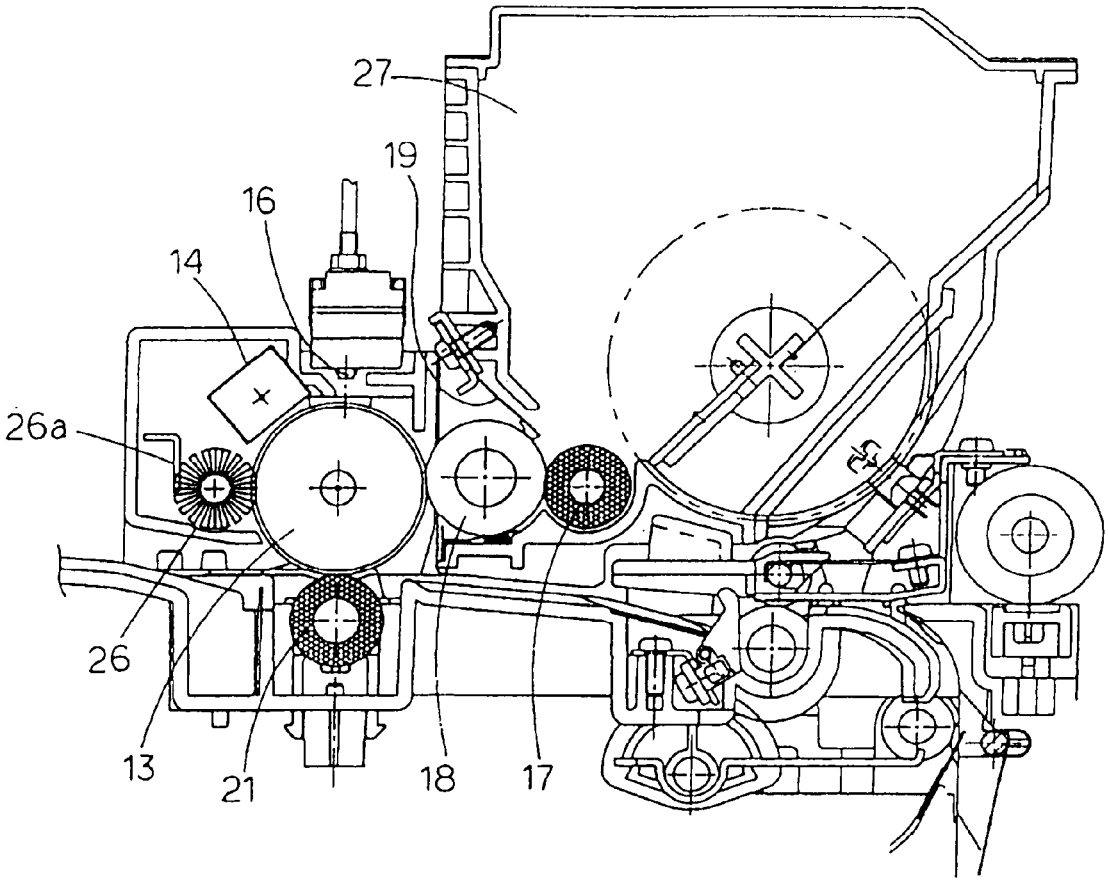
FIG. 3 is a cross-sectional side view showing a configuration of a printer section.

A paper feed mechanism is disposed at a paper feeding side for feeding the papers set in a paper feed cassette (not shown) one sheet at a time. In the paper feed mechanism, the paper feed roller 40 and the motor 41 are interlocked via the clutch 42. When feeding a paper from the paper feed cassette, the paper feed roller 40 is connected to the motor 41 by the clutch 42, and by the paper feed roller 40 being rotated. The papers in the paper feed cassette are fed one sheet at a time. Further, FIG. 3 shows a cross-section of the mechanism of the printer 101 in details. A paper dust removing brush loosening plate (flicker) 26*a* shown in FIG. 3 has a function for scattering the toner trapped in the paper dust removing brush 26, and a function for raising fallen hairs of the paper dust removing brush 26.

Figure 5:
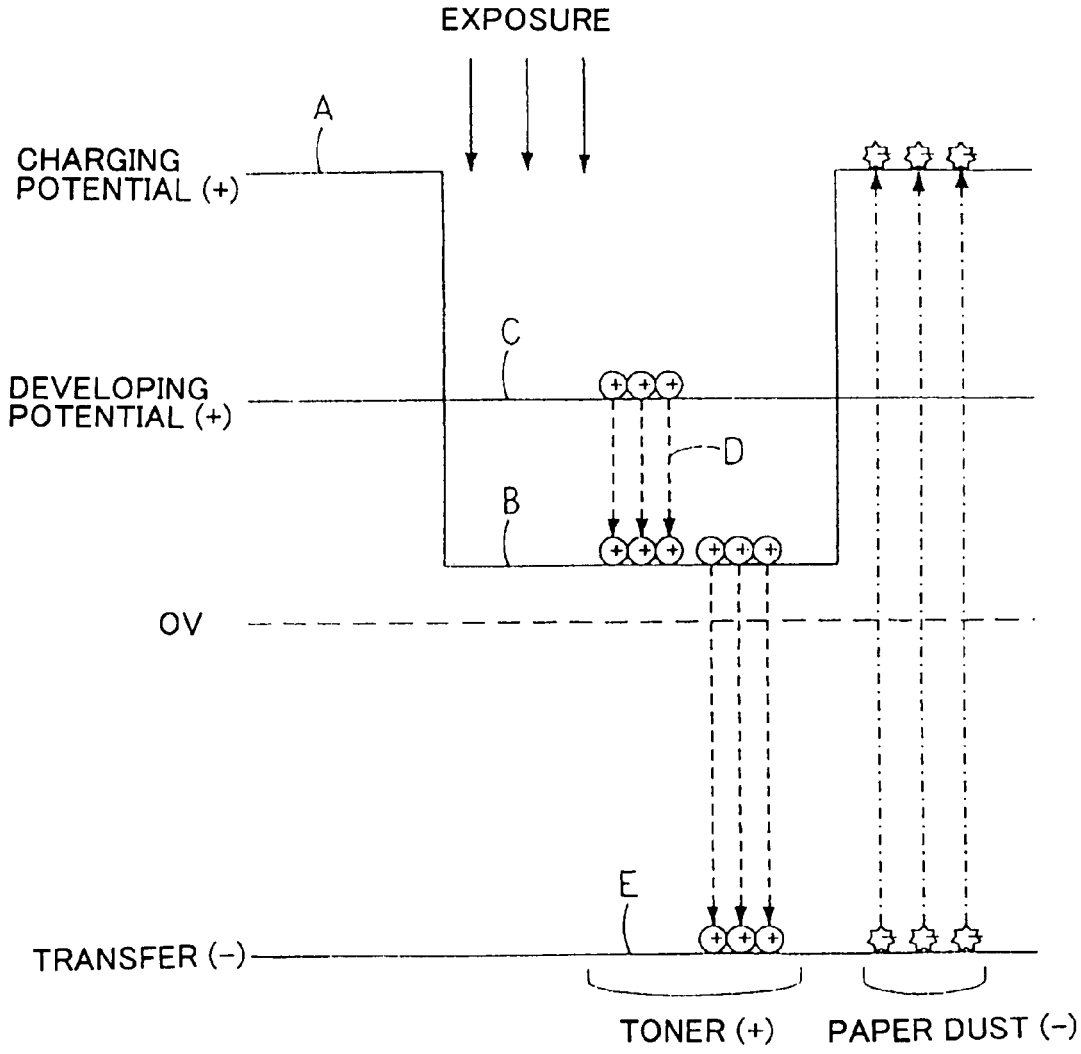
FIG. 5 shows a potential level of each of the parts for describing a printing operation of the printer section.

Next, the operation of the image forming device 100 will be described. The surface of the photoconductive drum 13 is charged uniformly at approximately +800V (potential A) by the scorotron charger 14. An electrostatic latent image corresponding to the image information is formed on the surface of the photoconductive drum 13 by the LED print head 16 (potential B). Then, as shown with an arrow D in FIG. 5, the toner held by the developing roller 18 of potential C is adhered to the electrostatic latent image on the surface of the photoconductive drum 13, and the toner image is formed on the surface of the photoconductive drum 13. Then, the toner image on the surface of the photoconductive drum 13 is transferred onto a paper by the transfer roller 21 of potential E. After the toner image is transferred, the toner image on the paper is heat-pressed by the heat roller 23 and the press roller 25, and the toner image is fused on the paper as a permanent image. The negatively charged paper dusts are sucked to the surface of the positively charged photoconductive drum 13, and adheres to the photoconductive drum 13. By the rotation of the photoconductive drum 13, the adhered paper dusts move to where the paper dust removing brush 26 is provided, and are removed by the paper dust removing brush 26.

Figure 6:
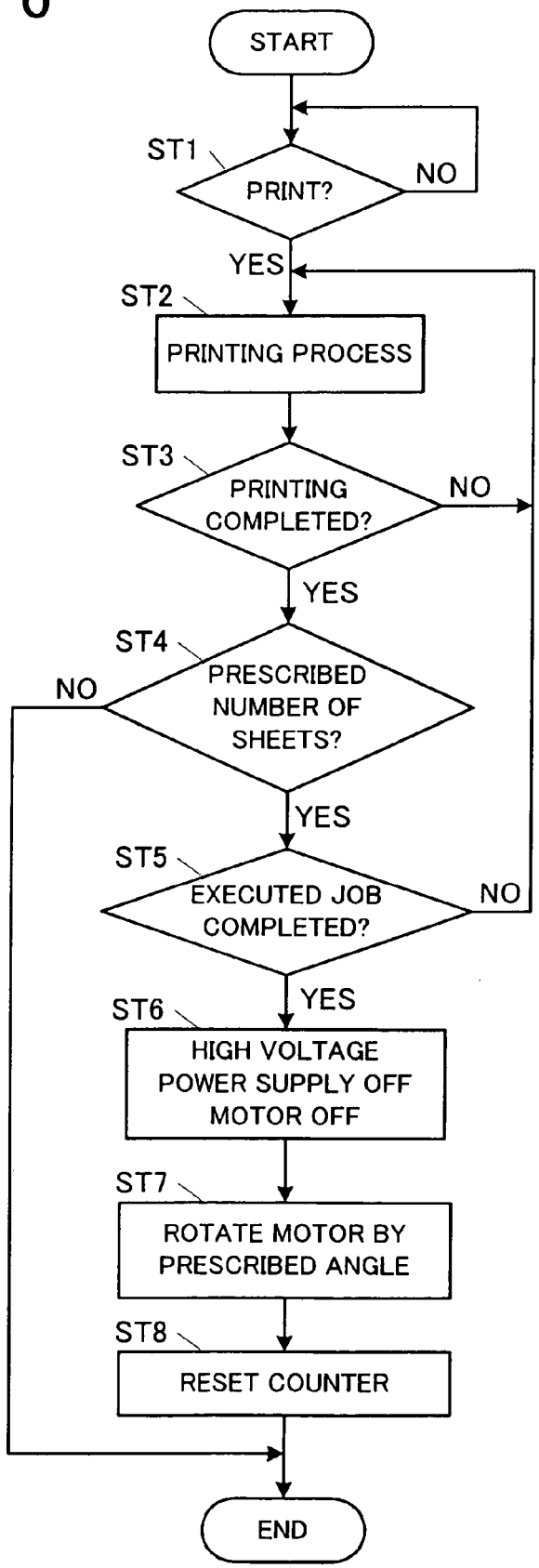
FIG. 6 is a flowchart for describing an operation of the paper dust removing brush.

Next, the processing operation of the intermittent rotation of the paper dust removing brush 26 of the image forming device 100 will be described with reference to FIG. 6. When the operation starts, in step ST1, it is determined whether or not a processing command is a print command. When it is determined that the processing command is not a print command, the process goes on standby in step ST1, and the process does not proceed to a subsequent process. Meanwhile, when it is determined that the processing command is a print command, the process proceeds to step ST2. In step ST2, a print processing is executed by the printer section. During the print processing, to determine whether or not to rotate and drive the paper dust removing brush 26, the sheet counter 12*a* holds a number of printed sheets counted cumulatively from a previous reset time.

When the print processing is executed, the process proceeds to step ST3. In step ST3, it is determined whether or not the printing process has been completed. When it is determined that the printing process has not been completed yet, the process returns to step ST2 and the printing process continues. Meanwhile, when it is determined that the printing process has been completed, the process proceeds to step ST4. In step ST4, it is determined whether or not a counted value of the sheet counter 12*a* has reached a prescribed number of sheets. When it is determined that a prescribed number of sheets has not been reached yet, since it is not necessary to rotate the paper dust removing brush 26, the process ends without carrying out any other process. Meanwhile, when it is determined that a prescribed number of sheets has been reached, the process proceeds to step ST5.

In step ST5, it is determined whether or not the executed job has been completed. Since the printing process is generally completed, it is determined that the job has been completed, and the process proceeds to step ST6. In step ST6, a high voltage power supply and the motor 41 are switched OFF. Accordingly, the photoconductive drum 13 is also stopped. Next, the process proceeds to step ST7. In step ST7, the motor 41 rotates backward by a prescribed angle, and the photoconductive drum 13 also rotates backward. As a result, the paper dust removing brush 26 also rotates by a prescribed angle. The paper dust removing brush 26 is now located at a new contacting position with respect to the photoconductive drum 13, and the former contacting position of the paper dust removing brush 26 is no longer contacting the photoconductive drum 13. Therefore, the same effect can be obtained as when the brush is replaced with a new fixed type paper dust removing brush. Lastly, the process proceeds to step ST8. The counted value of the sheet counter 12*a* is reset, and the process ends.

Further, in the present embodiment, the paper dust removing brush rotates each time a prescribed number of sheets are printed. However, the paper dust removing brush may rotate each time a prescribed period of time elapses or each time a prescribed date has been reached. Alternatively, by confirming the amount of the paper dust, the paper dust removing brush may be rotated manually.

Moreover, in the present embodiment, the paper dust removing brush 26 is attached to a drum unit, but the paper dust removing brush 26 may be attached to the image forming device 100 main body. In the case of the former, when the drum unit is replaced, the paper dust removing brush attached to the drum unit is also replaced. As a result, the paper dust removing ability recovers. In the case of the latter, in other words, when the paper dust removing brush 26 is attached to the device main body, the paper dust removing ability cannot be expected to recover by replacing the drum unit. Therefore, it is preferable for the contacting surface between the paper dust removing brush and the photoconductive drum to be switched each time the drum unit is replaced, and the paper dust to be removed by a new clean surface. An example of this configuration is shown in FIGS. 7A through 7C.

Figure 7A:
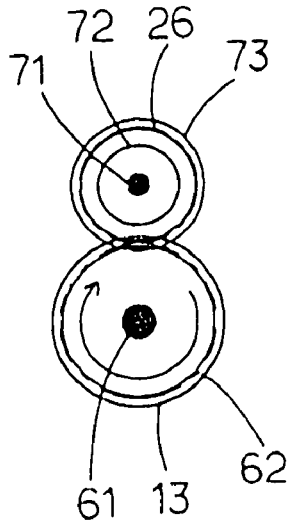
FIGS. 7A through 7C show another example of the transfer mechanism of the driving force to the paper dust removing brush.
Figure 7B:
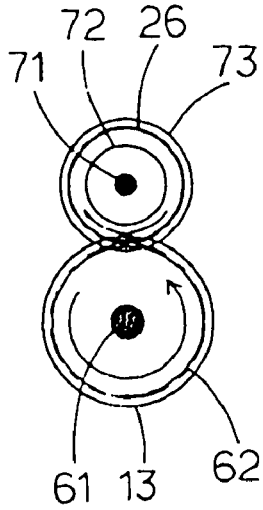
Figure 7C:
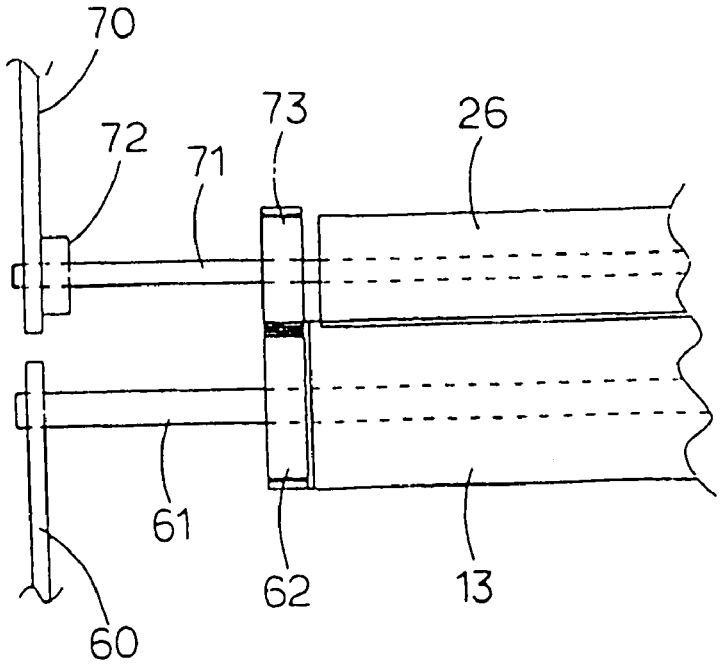

As shown in FIG. 7C, a rotational shaft 61 of the photoconductive drum 13 is supported rotatable by a drum unit 60. A drum gear 62 is attached to an edge of the photoconductive drum 13, and the drum gear 62 and the photoconductive drum 13 are supported by the rotational shaft 61. When the rotational shaft 61 rotates, the photoconductive drum 13 and the drum gear 62 are rotated as one body.

Meanwhile, here, the paper dust removing brush 26 is formed as a roller shape. A rotational shaft 71 of the paper dust removing brush 26 is supported rotatable by a one-way bearing 72 fixed on a main body frame 70. Moreover, the paper dust removing brush 26 and a one-way gear 73 at a periphery of an edge of the paper dust removing brush 26 are attached to the rotational shaft 71. The one-way gear 73 and the drum gear 62 are engaged with one another to transfer the driving force from the drum gear 62 to the paper dust removing brush 26 only when the photoconductive drum 13 rotates in a direction that is backward of the rotation in the image forming operation.

According to the above-described configuration, as shown in FIG. 7A, when the motor 41 rotates forward (at normal printing operation), the photoconductive drum 13 rotates in a direction shown with an arrow. At this time, the one-way gear 73 engaged with the drum gear 62 also rotates, but the one-way gear 73 idles with respect to the rotational shaft 71, and the rotational shaft 71 does not rotate. Therefore, the position of the paper dust removing brush 26 is fixed and not changed. Of course, the position of the paper dust removing brush 26 is also fixed when the motor 41 does not rotate.

When replacing the drum unit 60, the motor 41 rotates backward for a prescribed period of time. In this case, as shown in FIG. 7B, the photoconductive drum 13 rotates in a direction shown with an arrow. Accompanying the rotation of the photoconductive drum 13, the one-way gear 73 also rotates. In this case, the rotation of the one-way gear 73 is transferred to the rotational shaft 71, and the rotational shaft 71 also rotates. Therefore, the paper dust removing brush 26 also rotates, and the contacting position between the paper dust removing brush 26 and the photoconductive drum 13 changes. Accordingly, a new clean surface of the paper dust removing brush 26 contacts against the photoconductive drum 13, and the paper dust removing ability recovers.

In this case, since the paper dust removing brush 26 is attached to the main body frame 70 (device main body), the cost of the drum unit 60, which is a consumable, can be reduced. Further, the period of time for rotating the paper dust removing brush 26 is preferable to be a period of time corresponding to approximately 30 degrees by the rotation angle of the paper dust removing brush 26 as described above.

What is claimed is:

1. An image forming device comprising:

a photoconductive drum;

a motor which rotates the photoconductive drum;

means for charging a surface of the photoconductive drum;

means for exposing to write image information as an electrostatic latent image onto the charged surface of the photoconductive drum;

means for developing the electrostatic latent image;

means for transferring the developed image onto a paper;

means for removing paper dust by contacting against the surface of the photoconductive drum; and a rotation mechanism which intermittently rotates the means for removing the paper dusts, wherein the rotation mechanism rotates the means for removing the paper dusts according to a backward rotation of the photoconductive drum.

2. The image forming device according to claim 1, wherein a period of time when the photoconductive drum rotates backward is a period of time corresponding to approximately 30 degrees by a rotation angle.

3. An image forming device comprising:

a photoconductive drum;

a motor which rotates the photoconductive drum;

means for charging a surface of the photoconductive drum;

means for exposing to write image information as an electrostatic latent image onto the charged surface of the photoconductive drum;

means for developing the electrostatic latent image;

means for transferring the developed image onto a paper;

means for removing paper dust by contacting against the surface of the photoconductive drum, provided as a replaceable unit with respect to a device main body; and a rotation mechanism which intermittently rotates the means for removing the paper dusts, wherein the rotation mechanism is provided on a shaft of the means for removing the paper dust, and is a gear with a one-way clutch which engages with a gear of the photoconductive drum, and the gear with one-way clutch transfers a backward rotation of the photoconductive drum to the shaft.

4. The image forming device according to claim 3, wherein a period of time when the photoconductive drum rotates backward is a period of time corresponding to approximately 30 degrees by a rotation angle.

5. An image forming device comprising:

a photoconductive drum;

a motor which rotates the photoconductive drum;

means for charging a surface of the photoconductive drum;

means for exposing to write image information as an electrostatic latent image onto the charged surface of the photoconductive drum;

means for developing the electrostatic latent image;

means for transferring the developed image onto a paper;

means for removing paper dust by contacting against the surface of the photoconductive drum, provided as a replaceable unit with respect to a device main body;

a rotation mechanism which intermittently rotates the means for removing the paper dusts;

a sheet counter which cumulatively counts a number of printed sheets;

means for determining whether or not a counted value of the sheet counter has reached a prescribed number of sheets; and a controller which rotates a motor by a prescribed angle so that the photoconductive drum is rotated backward when it is determined that the counted value of the sheet counter has reached the prescribed number of sheets.

6. The image forming device according to claim 5, wherein the controller resets the counted value of the sheet counter after the photoconductive drum rotates backward.

7. An image forming device comprising:

a photoconductive drum;

a motor which rotates the photoconductive drum;

means for charging a surface of the photoconductive drum;

means for exposing to write image information as an electrostatic latent image onto the charged surface of the photoconductive drum;

means for developing the electrostatic latent image;

means for transferring the developed image onto a paper;

means for removing paper dust by contacting against the surface of the photoconductive drum;

a rotation mechanism which intermittently rotates the means for removing the paper dusts;

a main body which supports the means for removing the paper dust rotatable; and a unit which supports the photoconductive drum rotatable, and can be replaced with respect to the main body, wherein the rotation mechanism is provided to a shaft of the means for removing the paper dust, and is a gear with a one-way clutch which engages with a gear of the photoconductive drum, and the gear with one-way clutch transfers a backward rotation of the photoconductive drum to the shaft.

8. The image forming device according to claim 7, wherein a period of time when the photoconductive drum rotates backward is a period of time corresponding to approximately 30 degrees by a rotation angle.

9. The image forming device according to claim 7, wherein the photoconductive drum rotates backward when replacing the unit.

* * * * *